US006485399B2

(12) United States Patent
Greene

(10) Patent No.: US 6,485,399 B2
(45) Date of Patent: Nov. 26, 2002

(54) LEG EXERCISE DEVICE

(76) Inventor: Benjamin O. Greene, 261 Cedar La., Guyton, GA (US) 31312

( * ) Notice: Subject to any disclaimer, the term of this patent is extended or adjusted under 35 U.S.C. 154(b) by 132 days.

(21) Appl. No.: 09/766,119

(22) Filed: Jan. 19, 2001

(65) Prior Publication Data

US 2002/0098955 A1 Jul. 25, 2002

(51) Int. Cl.[7] ..... A63B 21/072; A63B 21/073; A63B 21/06

(52) U.S. Cl. ..... 482/106; 482/93; 482/108

(58) Field of Search ..... 482/105, 106, 482/107, 108, 109, 139, 140, 79, 57, 62, 93

(56) References Cited

U.S. PATENT DOCUMENTS

| | | | | | |
|---|---|---|---|---|---|
| 2,214,052 | A | * | 9/1940 | Good | 482/105 |
| 4,345,756 | A | * | 8/1982 | Hoagland | 482/108 |
| 4,618,143 | A | | 10/1986 | Twardosz | |
| 4,798,377 | A | * | 1/1989 | White | 482/49 |
| 4,807,873 | A | * | 2/1989 | Naquin | 482/105 |
| 4,964,631 | A | * | 10/1990 | Marano | 482/105 |
| 5,242,342 | A | | 9/1993 | Silverman | |
| 5,393,284 | A | | 2/1995 | Wesley | |
| 5,716,305 | A | | 2/1998 | Selsam | |
| 5,989,162 | A | * | 11/1999 | Daniels | 482/62 |
| 6,196,951 | B1 | * | 3/2001 | Shepherd | 482/106 |

* cited by examiner

*Primary Examiner*—Jerome W. Donnelly
*Assistant Examiner*—Fenn C Mathew
(74) *Attorney, Agent, or Firm*—Henderson & Sturm LLP

(57) ABSTRACT

A leg exercise device adapted for use with an adjustable dumbbell independent of a weight bench. The leg exercise device includes a bracket with a central sleeve that receives the bar of an adjustable dumbbell. Weight plates are attached to one end of the dumbbell bar and secured by a locking collar, while the other end of the bar receives a locking collar to secure the bar within the sleeve. A pair of opposing side portions extend out from the central sleeve and a foot handle is rotatable attached to each side portion. The foot handles include a pair of spaced outwardly extending padded fingers that engage opposite sides of the user's foot. The leg exercise device may be used to do leg extensions or leg curls on a weight bench that does not have an attachment designed for that purpose. The foot handles rotate while leg extensions or leg curls are being done so that the weight resistance automatically adjusts throughout the eccentric and concentric phases of each exercise.

3 Claims, 2 Drawing Sheets

LEG EXERCISE DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of exercise devices, and more particularly to an exercise device for leg extensions and curls.

2. Description of Related Art

As can be seen by reference to the following U.S. Pat. Nos. 4,618,143; 5,242,342; 5,393,284 and 5,716,305, the prior art is replete with myriad and diverse exercise devices.

While all of the aforementioned prior art constructions are more than adequate for the basic purpose and function for which they have been specifically designed, they are uniformly deficient with respect to their failure to provide a simple, efficient, and practical leg exercise device for leg extensions and curls that is independent of a weight bench.

As a consequence of the foregoing situation, there has existed a longstanding need for a new and improved leg exercise device and the provision of such a construction is a stated objective of the present invention.

BRIEF SUMMARY OF THE INVENTION

Briefly stated, the present invention provides a leg exercise device adapted for use with an adjustable dumbbell independent of a weight bench. The leg exercise device includes a bracket with a central sleeve that receives the bar of an adjustable dumbbell. Weight plates are attached to one end of the dumbbell bar and secured by a locking collar, while the other end of the bar receives a locking collar to secure the bar within the sleeve. A pair of opposing side portions extend out from the central sleeve and a foot handle is rotatable attached to each side portion. The foot handles include a pair of spaced outwardly extending padded fingers that engage opposite sides of the user's foot. The leg exercise device may be used to do leg extensions or leg curls on a weight bench that does not have an attachment designed for that purpose. The foot handles rotate while leg extensions or leg curls are being done so that the weight resistance automatically adjusts throughout the eccentric and concentric phases of each exercise.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
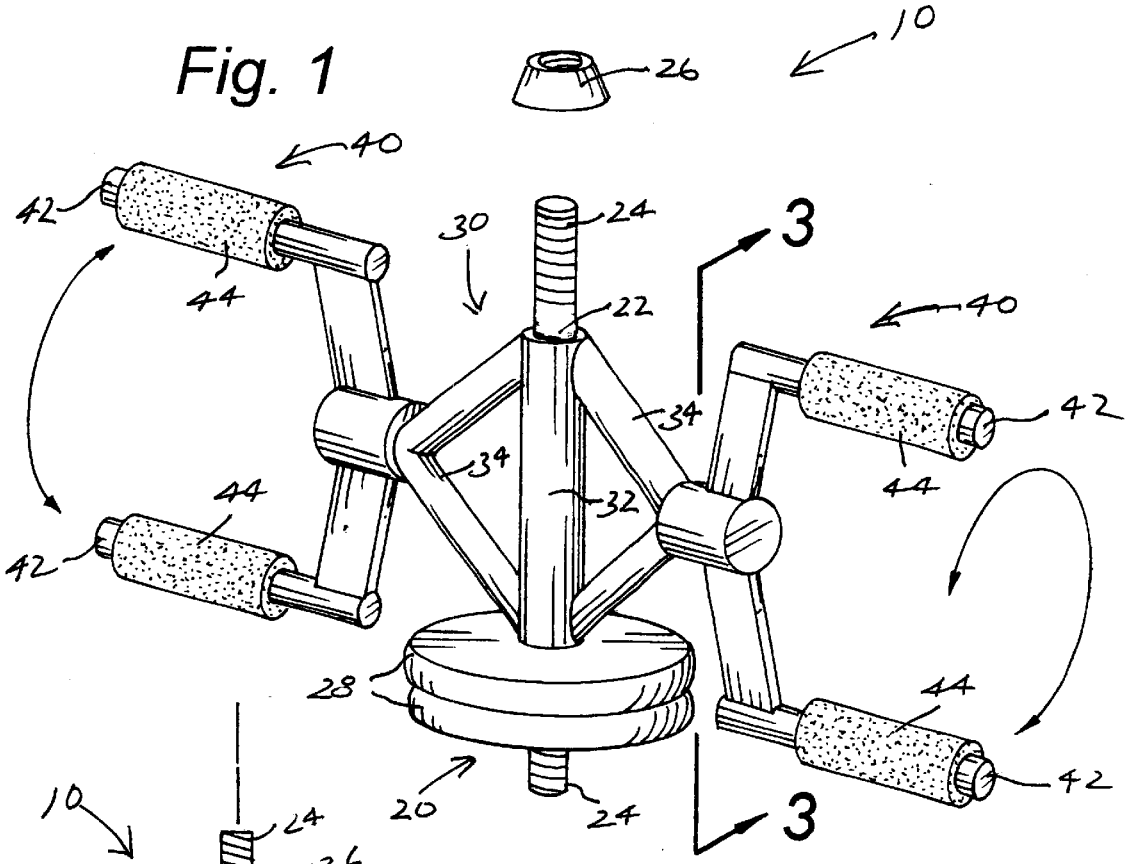
FIG. 1 is a perspective view showing the leg exercise device of the present invention with an adjustable dumbbell being attached.

As can be seen by reference to the drawings, and in particularly to FIG. 1, the leg exercise device that forms the basis of the present invention is designated generally by the reference number 10. The leg exercise device 10 is used with an adjustable dumbbell 20 including an elongated bar 22 with threaded ends 24 that receive threaded locking collars 26 to secure a number of desired weight plates 28. The exercise device 10 includes a bracket 30 having an elongated central sleeve 32 that selectively receives the bar 22, and a pair of opposing side portions 34.

Figure 2:
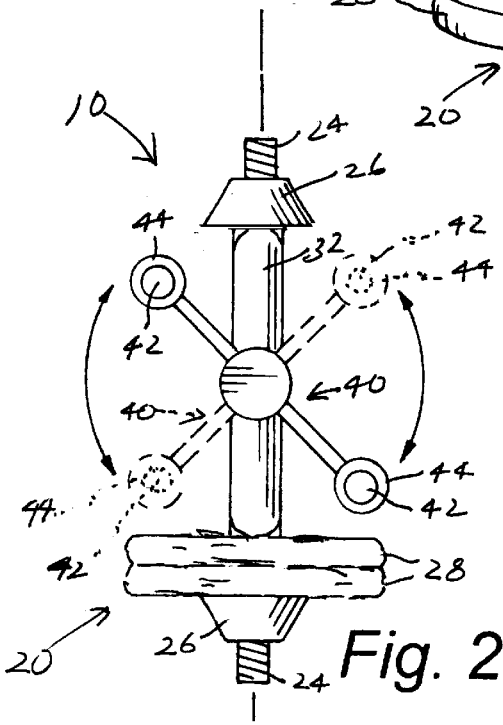
FIG. 2 is a side elevational view thereof illustrating the rotational movement of the foot handles.
Figure 3:
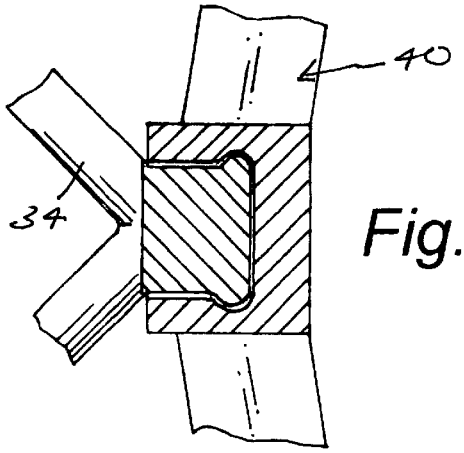
FIG. 3 is an enlarged partial sectional view taken along line 3—3 of FIG. 1 showing the rotational attachment at the foot handle to the side portion of the bracket.
Figure 4:
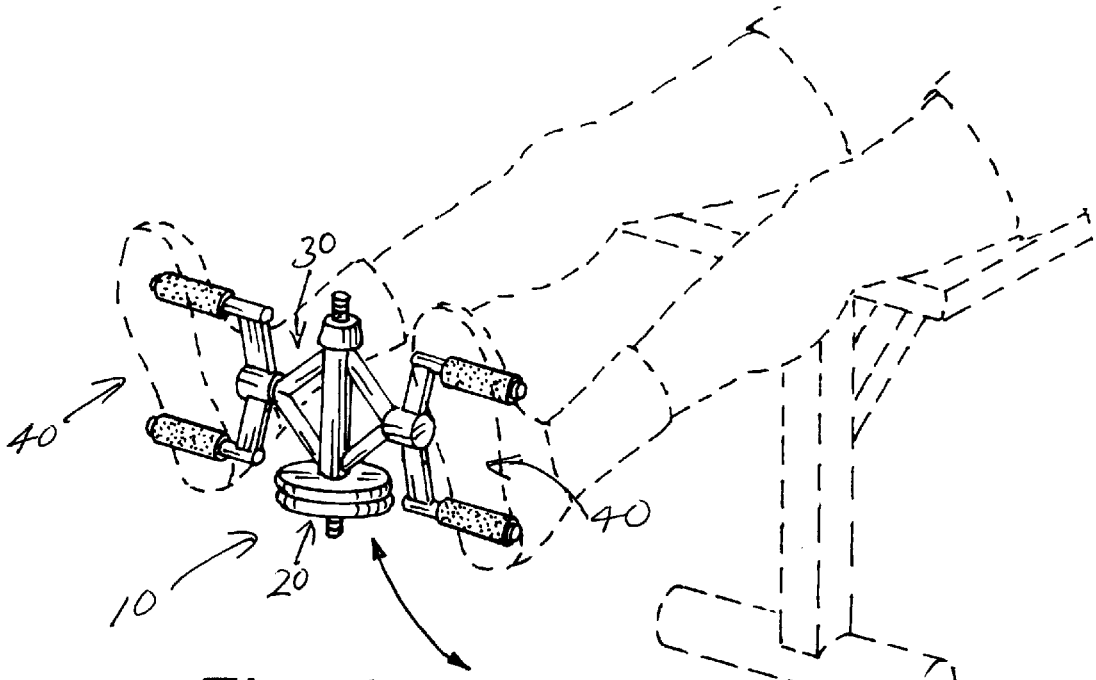
FIG. 4 is a perspective view showing the leg exercise device being used to do leg extensions.
Figure 5:
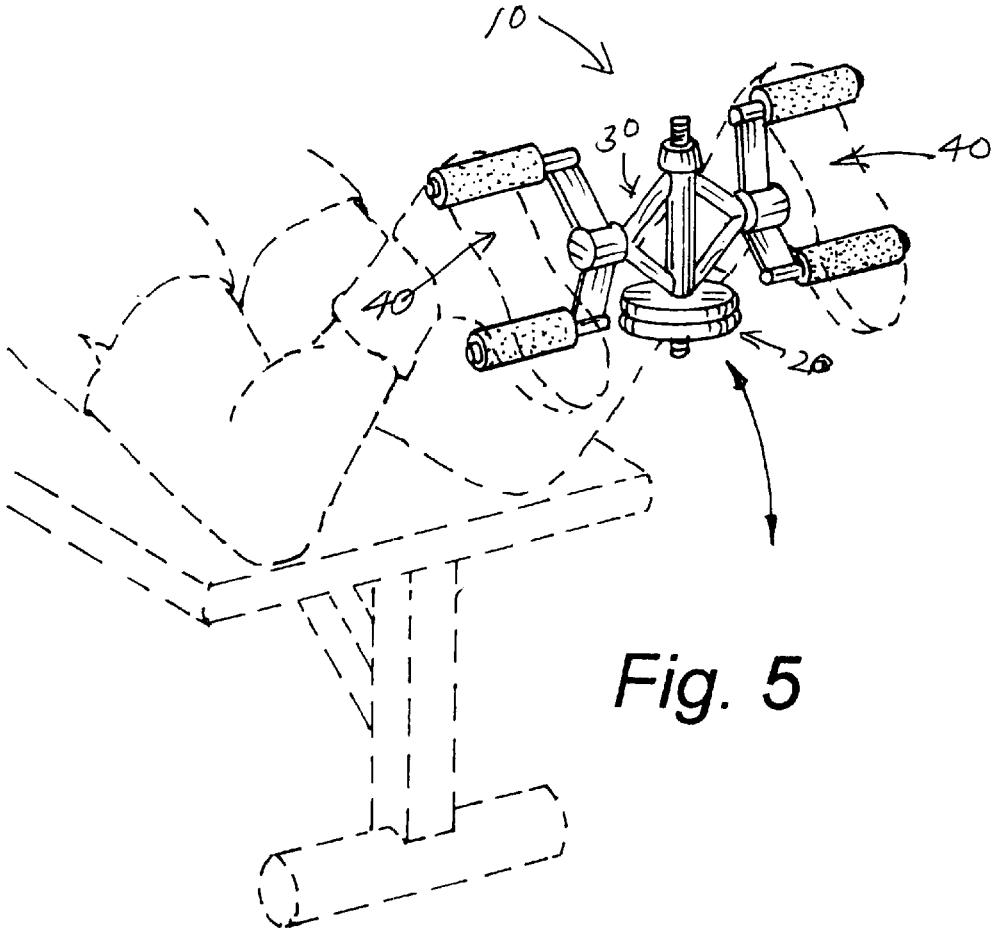
FIG. 5 is a perspective view showing the leg exercise device being used to do leg curls.

A foot handle 40 is rotatable attached to each side portion 34 as illustrated in FIGS. 1–3. Each foot handle 40 includes a pair of spaced outwardly extending fingers 42 that carry padding 44. As best illustrated in FIGS. 4 and 5, the fingers 42 engage opposite sides of the user's foot while in use for doing leg extensions or leg curls. It is to be understood that the number and size of the weight plates 28 may be varied to suit the user.

In use, the adjustable dumbbell 20 with the desired number of weight plates 28 is secured to the bracket 30 by engagement of the locking collars 26 to the threaded ends 24 of the bar 22. The user's foot is then placed in the foot handles 40 so that the pads 44 of the spaced fingers 42 engage opposite sides of the user's foot. The user may then do leg extensions or leg curls as illustrated in FIGS. 4 and 5.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A leg exercise device adapted for use with an adjustable dumbbell having an elongated bar, weight plates selectively secured to the bar, and locking collars disposed to engage ends of the bar, the leg exercise device comprising:

a bracket including a centrally located elongated sleeve disposed to receive the bar of the dumbbell wherein the ends of the bar extend out from the sleeve to selectively engage the weight plates and locking collars, and a pair of opposing side portions extending out from the central sleeve;

a foot handle rotatably attached to each side portion of the bracket, each foot handle including a pair of spaced outwardly extending fingers disposed to engage opposite sides of a user's foot.

2. The leg exercise device of claim 1 wherein the fingers of the foot handle are padded.

3. The leg exercise device of claim 1 wherein the ends of the dumbbell bar and the locking collars are threaded.

* * * * *